US008834305B2

(12) United States Patent
Cain

(10) Patent No.: US 8,834,305 B2
(45) **Date of Patent: *Sep. 16, 2014**

(54) REINFORCED BAMBOO LACROSSE SHAFT

(75) Inventor: Paul Cain, Arnold, MD (US)

(73) Assignee: Bamshaft, Inc., Arnold, MD (US)

( * ) Notice: Subject to any disclaimer, the term of this patent is extended or adjusted under 35 U.S.C. 154(b) by 154 days.

This patent is subject to a terminal disclaimer.

(21) Appl. No.: 13/170,829

(22) Filed: Jun. 28, 2011

(65) Prior Publication Data

US 2013/0005516 A1 Jan. 3, 2013

(51) Int. Cl.
*A63B 59/02* (2006.01)
*A63B 65/12* (2006.01)

(52) U.S. Cl.
CPC ..... *A63B 59/02* (2013.01)
USPC ..... 473/513; D21/724

(58) Field of Classification Search
USPC ..... 473/505, 512, 513
See application file for complete search history.

(56) References Cited

U.S. PATENT DOCUMENTS

| | | | | | |
|---|---|---|---|---|---|
| 1,288,763 | A * | 12/1918 | Turner | 52/851 |
| 1,450,646 | A * | 4/1923 | Sadenwater | 473/564 |
| 2,370,033 | A * | 2/1945 | Hall | 144/348 |
| 2,596,894 | A * | 5/1952 | Frisch | 473/513 |
| 2,782,035 | A * | 2/1957 | East | 473/297 |
| 3,700,535 | A * | 10/1972 | McCoy et al. | 428/367 |
| 3,702,702 | A * | 11/1972 | Hoult | 473/513 |
| 4,043,074 | A * | 8/1977 | Airhart | 43/18.5 |
| 4,575,444 | A * | 3/1986 | Paradis | 264/291 |
| 4,584,247 | A * | 4/1986 | Mulholland | 428/592 |
| 4,836,545 | A * | 6/1989 | Pompa | 473/320 |
| 4,968,549 | A * | 11/1990 | Smimizu et al. | 428/106 |
| 5,476,706 | A * | 12/1995 | Shimizu | 428/136 |
| 6,007,440 | A * | 12/1999 | Bender et al. | 473/564 |
| 6,916,261 | B2 | 7/2005 | Cullen et al. | |
| 7,615,129 | B2 * | 11/2009 | Wilbur et al. | 156/94 |
| 2002/0037780 | A1 * | 3/2002 | York et al. | 473/560 |
| 2004/0029660 | A1 | 2/2004 | Chen et al. | |
| 2005/0075201 | A1 * | 4/2005 | Cullen et al. | 473/559 |
| 2008/0020871 | A1 * | 1/2008 | Morrow et al. | 473/513 |
| 2010/0258243 | A1 * | 10/2010 | Lin et al. | 156/259 |
| 2011/0124446 | A1 * | 5/2011 | McGuire et al. | 473/513 |
| 2011/0250995 | A1 * | 10/2011 | Cain | 473/513 |
| 2013/0005516 | A1 * | 1/2013 | Cain | 473/513 |

OTHER PUBLICATIONS

Webpage download, hikstik'2008, 2008,web.archive.org/web/20080421105636/http://www.hikstik.com/prototypes.html, 4 pages.*
Webpage download, Inside Lacrosse, 2005,forums.insidelacrosse.com/showthread.php?28100-Making-a-Wooden-Shaft, 8 pages.*
Webpage download, BuryCompanies, 2008, web.archive.org/web/20080423114128/http://burycompanies.com/rebar.html, 1 page.*
Webpage download, RetroRail, 2001, web.archive.org/web/20001020140842/http://www.hautestick.com/LaxGear/LaxShaft/Retro/Retro-Main.html, 2 pages.*

* cited by examiner

*Primary Examiner* — Gene Kim
*Assistant Examiner* — M Chambers
(74) *Attorney, Agent, or Firm* — Steptoe & Johnson LLP

(57) ABSTRACT

Bamboo lacrosse shafts and methods for manufacturing bamboo lacrosse shafts are disclosed.

16 Claims, 9 Drawing Sheets

REINFORCED BAMBOO LACROSSE SHAFT

TECHNICAL FIELD

This invention relates to a reinforced bamboo shaft for a lacrosse stick.

BACKGROUND

When playing lacrosse, it is desirable to have a shaft that is strong, flexible, and has a good feel to the player. In addition, when playing in cold weather, it can be desirable to have a shaft that thermally insulates a player's hands.

SUMMARY

Lacrosse is played with a long-handled instrument known as a lacrosse stick. The lacrosse stick includes a head attached to a shaft. A player uses the stick to control the ball and to strike opposing players. Lacrosse shafts may be constructed from any suitable material including wood, metal, plastic, or fiberglass. Historically, lacrosse sticks were often constructed from hickory or other hardwoods. More recently, aluminum, titanium, scandium or other metals, including alloys, have been substituted. While metal shafts offer superior shear and tensile strengths compared to wooden shafts, they may also lack sensitivity. A player may, therefore, prefer the sensitivity of a wooden shaft, which more effectively transmits vibrations to their hands, and thereby provides improved feel while controlling the ball. A player may also prefer the way a wooden shaft insulates their hands while playing in cold weather, as opposed to a metal shaft that can strip heat from the player's hands. To overcome disadvantages of prior lacrosse shafts while retaining certain advantages, a new bamboo lacrosse shaft has been developed and is set forth herein.

Throughout the world, bamboo is gaining popularity as a construction material primarily due to its rapid growth rates and impressive material properties. For instance, under optimal conditions, bamboo may grow up to 48 inches in a 24 hour period making it one of the fastest growing plants on earth. As a result of this rapid growth, bamboo is typically ready for harvesting after only 2-3 years of life. In addition to rapid growth rates, bamboo also has impressive material properties due to strong fibers that provide longitudinal reinforcement. In fact, the tensile and shear strengths of bamboo may exceed those of aluminum. In addition to great strength, bamboo also boasts surprising flexibility, making it an excellent material for lacrosse shafts.

Before bamboo can be incorporated into a lacrosse shaft, it must undergo several processes. First, the bamboo must be harvested and split open to expose the internal membranes. Next, the internal membranes and external nodes must be removed. Then, the sugars must be removed from the bamboo to improve its resistance to warping and cracking over time. Also, if the sugars are not removed, the bamboo may be vulnerable to insect infestation. To remove the sugars, various processes may be used. For instance, the bamboo may be treated with pressurized steam in an autoclave. During this process, steam penetrates the cells of the bamboo and forces sugars out of the cells. Alternately, the bamboo may be placed into a chemical bath of sodium hydroxide to accomplish the same objective. Next, the sections of bamboo may be pressed flat to create layers. As a result of the sugar extraction step, the moisture content of the bamboo layers is high at this stage in the process. This high moisture content is an advantage during pressing, since the layers are more resistant to cracking.

However, high moisture levels are not desirable when constructing a lacrosse shaft since the excess moisture can interfere with performance of adhesives used to join layers of bamboo. Therefore, the bamboo layers must be adequately dried before joining.

Once the layers have been dried and squared, they are ready for incorporation into a shaft. A typical shaft ranges from 30 to 72 inches depending on the player's position, and the width and thickness are typically about ⅞ inch and 1 inch, respectively. Smaller players, such as children, may prefer smaller dimensions. Since a single processed bamboo layer is typically too thin to form a shaft by itself, it is necessary to join several layers of bamboo to achieve the desired width and thickness. For instance, a first bamboo layer may be joined to a second bamboo layer and a third bamboo layer. Depending on the desired thickness of the shaft, a fourth and fifth bamboo layer may also be added. Accordingly, bamboo layers may be added, removed or modified to alter the shaft's attributes, including strength, weight, thickness and flexibility.

Bamboo layers may be joined by applying an adhesive along their mating surfaces. The adhesive may include epoxy, wood glue, or any other suitable adhesive. Once the adhesive is applied, the bamboo layers can be secured with clamps or bands until the adhesive has cured. If a heat-activated adhesive is used, the bundles of bamboo layers may be placed in a kiln. Once the adhesive has cured and the bundles have cooled following exposure to the kiln, the bundles may be machined to achieve an octagonal cross-section. For instance, the bundle may be fixed while a milling bit may traverses the bundle from a first end to a second end to create one or more flat surfaces along its length. Alternately, a belt sander may be used to create flat surfaces along the length of the bundle. An octagonal cross section is desirable since it improves the player's grip on the shaft. However, any other shape could also be used, such as, for example, square, oval, circular, or hexagonal. Once the desired shaft profile is achieved, the shaft may be finished with hand sanding, which can be followed with an application of paint, varnish, and/or sealant. Due to sanding, the edges of the octagonal shaft may become rounded.

A bamboo lacrosse shaft having lamination planes in both horizontal and vertical orientations is known. Conversely, the bamboo lacrosse shaft described herein includes lamination planes in only one orientation. As a result, fewer failure modes are present, so increased strength is attained. To quantify differences in strength between the known shaft and the shaft described herein, physical testing of sample shafts was completed. The first shaft was a bamboo lacrosse shaft purchased from HIKSTIK.COM, LLC in March of 2010. The second shaft was a bamboo lacrosse shaft as described herein sold under the trademark BAMSHAFT by Bamshaft, Inc., Annapolis, Md. During testing, each shaft was supported at both ends and a point load was applied to the midpoint of each shaft. As shown in FIG. 13, the bamboo HIKSTIK failed when 234 pounds were applied to its midpoint, whereas the BAMSHAFT resisted failure until 281 pounds were applied to its midpoint. Since the external dimensions of the shafts were identical, the greater strength of the BAMSHAFT is attributed to the superior design described herein. In particular, by arranging the bamboo layers to form only parallel lamination planes, the resulting shaft possesses greater strength than a bamboo shaft having lamination planes in multiple directions.

In one aspect, a lacrosse shaft can include a first end, a second end opposite the first end, a first bamboo layer extending substantially from the first end to the second end, a second bamboo layer extending substantially from the first end to the second end and joined to the first bamboo layer along a first lamination plane, and a reinforcement member located between the first and second ends and disposed within the first or second bamboo layer. The reinforcement member can extend substantially from the first end to the second end of the shaft. Alternately, the reinforcement member extends 10-80%, 25-75% or 30-60% of the distance between the first and second ends. The reinforcement member has a width of about 0.125-1.0 inches, or, more preferably, a width of about 0.25-0.5 inches. The reinforcement member can include carbon fiber, aluminum, steel, titanium or fiberglass. The reinforcement member can include a carbon fiber rod. The reinforcement member can have rounded ends. The reinforcement member can be captured in a recess in the first bamboo layer, and alternately or in addition, the reinforcement member can be captured in a recess in the second bamboo layer.

In another aspect, a method of manufacturing a lacrosse shaft can include forming a recess in a first bamboo layer, inserting a reinforcement member into the recess, and joining the first bamboo layer to a second bamboo layer, wherein the reinforcement member is captured between the first and second bamboo layers. The method can include forming a second recess in the second bamboo layer prior to joining the first and second bamboo layers, wherein the second recess receives at least a portion of the reinforcement member. Forming the recess in the first bamboo layer can include routering a recess in the first bamboo layer. Likewise, forming the recess in the second bamboo layer can include a routering a recess in the second bamboo layer. The method can include machining joined layers to form a shaft, which, in one example, can have an octagonal cross-section. The method can include joining multiple pieces of bamboo to form the first bamboo layer, and, similarly, the method can include joining multiple pieces of bamboo to form the second bamboo layer. The method can also include rounding the ends of the reinforcement member.

DETAILED DESCRIPTION

Figure 1:
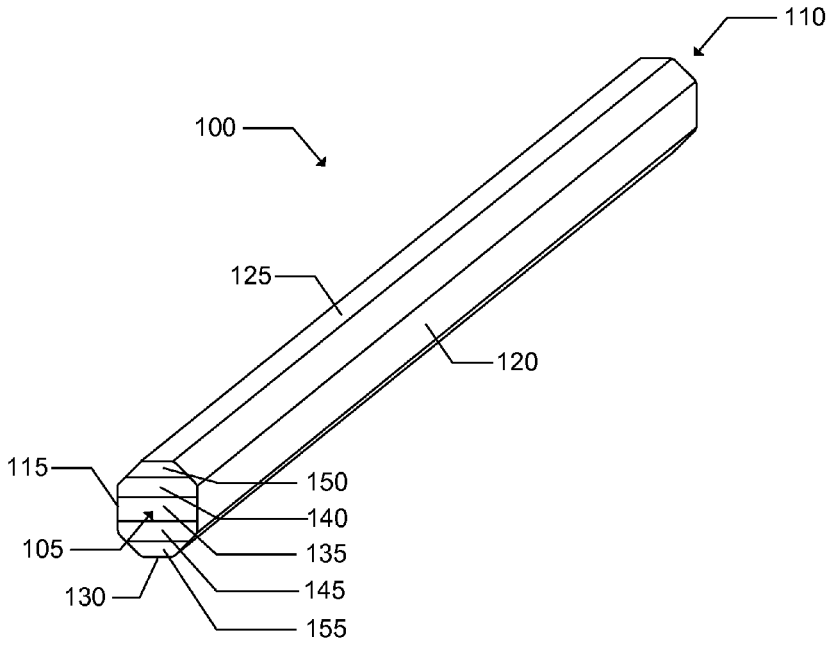
FIG. 1 is a perspective view of a bamboo lacrosse shaft.
Figure 2:
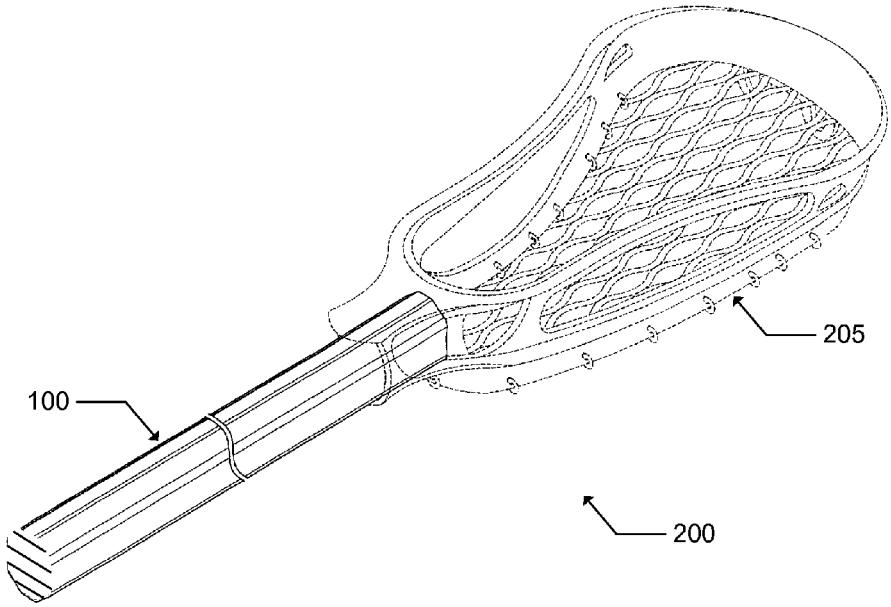
FIG. 2 is a side view of a lacrosse stick comprising a bamboo shaft and head.

As shown in FIG. 2, a lacrosse stick 200 may include a lacrosse head 205 attached to a bamboo lacrosse shaft 100. As shown in FIG. 1, the bamboo shaft 100 may include a first end 105, a second end 110, a first side surface 115, a second side surface 120, a top surface 125, and a bottom surface 130. The shaft may also include a first bamboo layer 135 extending from the first end 105 to the second end 110 and extending from the first side surface 115 to the second side surface 120. Alternately, the first bamboo layer 135 may extend substantially from the first side surface 115 substantially to the second side surface 120. For instance, the first bamboo layer 135 may begin within 0.25 inches of the first side surface 115 and extend toward the second side surface, ending within 0.25 inches from the second side surface 120.

Figure 3:
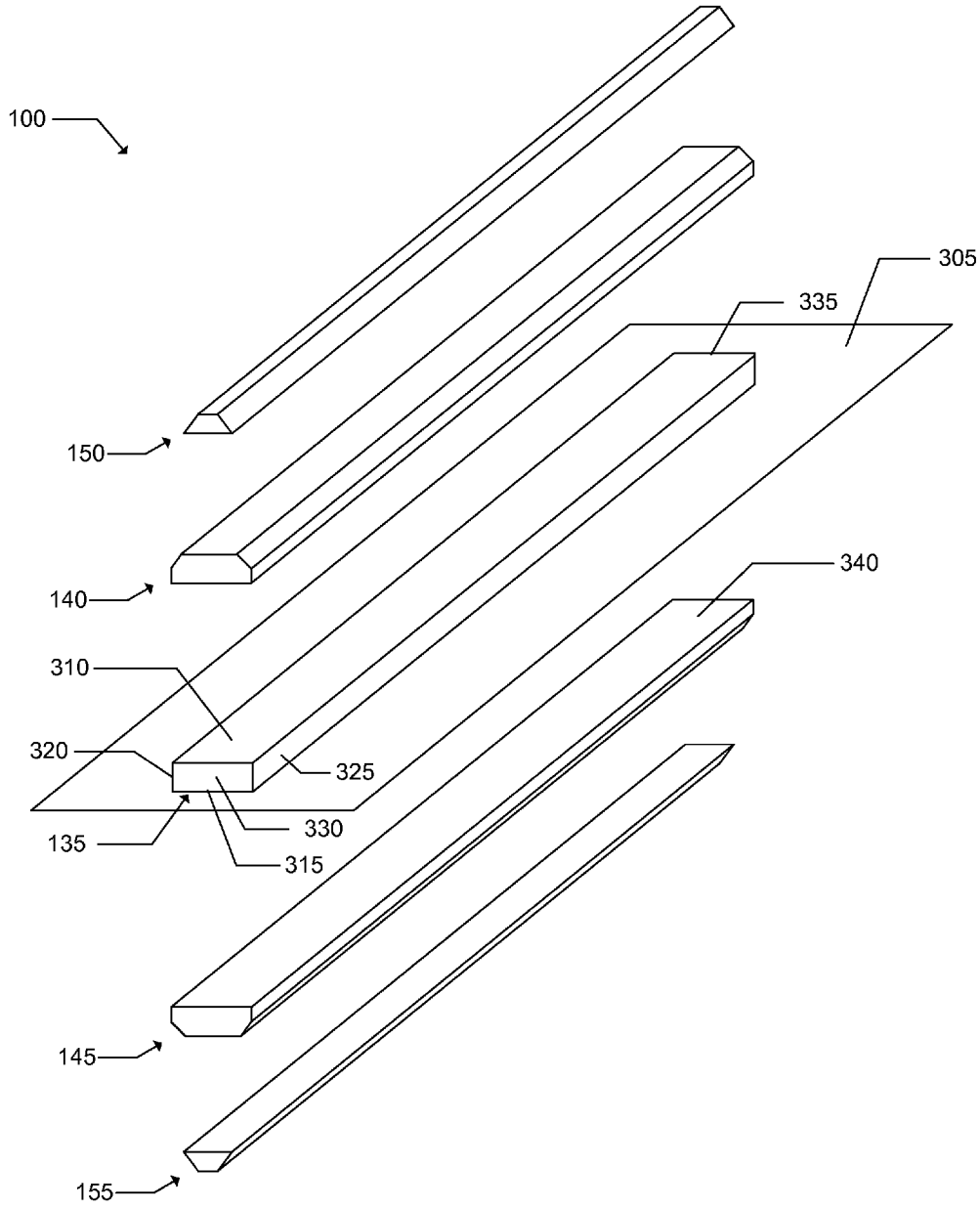
FIG. 3 is an exploded view of a bamboo lacrosse shaft.

As shown in FIG. 3, the first bamboo layer 135 may include a top surface 310, a bottom surface 315, a first side surface 320, a second side surface 325, a first end 330, and a second end 335. The width of the first bamboo layer is the shortest distance between the first side surface 320 and the second side surface 325. Likewise, the thickness of the first bamboo layer 135 is the shortest distance between the top surface 310 and the bottom surface 315. The length of the first bamboo layer 135 is the shortest distance between the first end 330 and the second end 335.

The outer dimensions of the bamboo layer 135 are constrained by the dimensions of the bamboo plant from which it is extracted. Depending on a player's personal preference, having a strong bamboo shaft may be desirable. Therefore, since fibers are more densely packed near the outer surface of the culm, it can be advantageous to extract the first bamboo layer 135 from the outer portion of the plant. However, if a player prefers a shaft with less strength and greater flex, the first bamboo layer 135 can be extracted from nearer the inner surface of the culm where fibers are less densely packed. In either case, the first bamboo layer 135 can include a width between 0.5 and 1.5 inches and a thickness between 0.0625 and 0.5 inches. More preferably, the width can be between 0.75 and 1.25, and the thickness can be between 0.125 to 0.375 inches. Although specific dimensions are provided, they are not intended to limit the scope of the invention, and, accordingly, the dimensions of the first bamboo layer can differ from those discussed herein.

Figure 6:
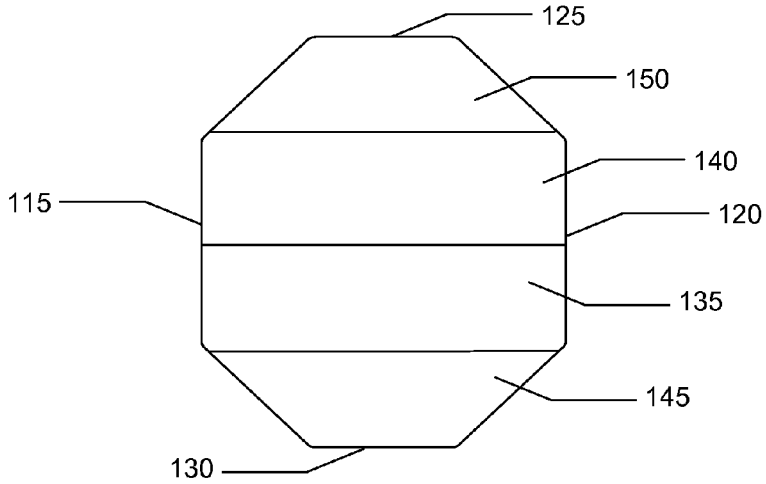
FIG. 6 is an end view of a bamboo lacrosse shaft.
Figure 7:
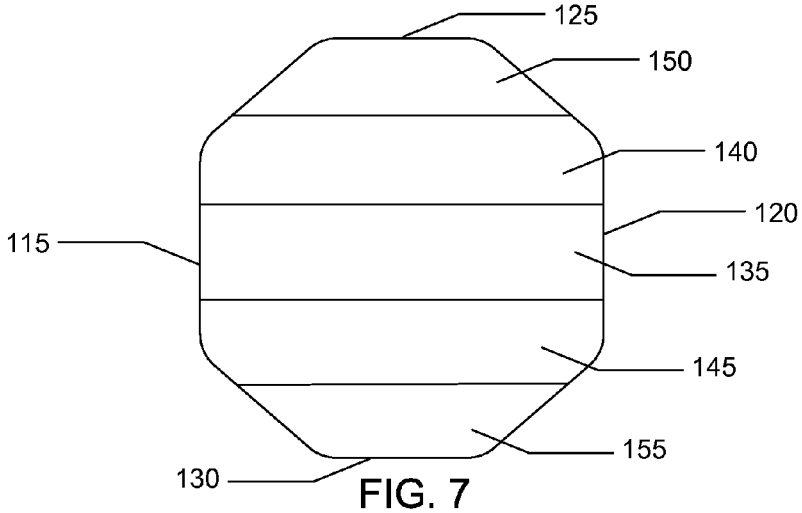
FIG. 7 is an end view of a bamboo lacrosse shaft.
Figure 8:
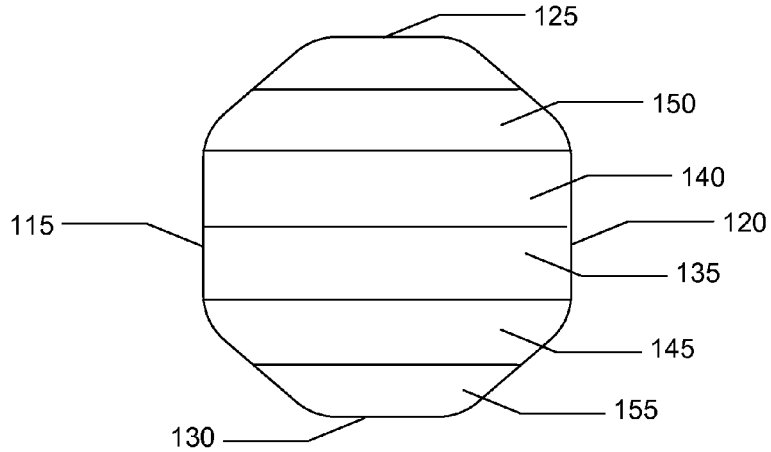
FIG. 8 is an end view of a bamboo lacrosse shaft.
Figure 9:
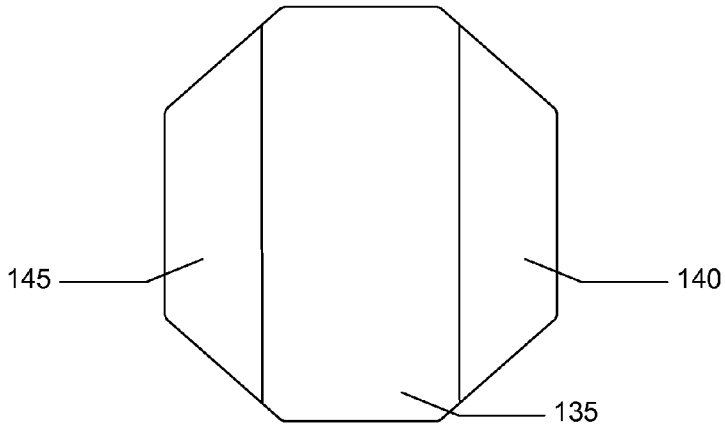
FIG. 9 is an end view of a bamboo lacrosse shaft.

As shown in FIG. 1, the shaft 100 may also include a second bamboo layer 145 extending from the first end 105 to the second end 110. The second bamboo layer may extend from the first side 115 to the second side 120 as shown in FIGS. 6, 7, and 8. However, in some configurations, the second bamboo layer 145 may have a width less than the width of the first bamboo layer 135. For instance, when the layers are oriented in a vertical configuration as shown in FIG. 9, the width of the second bamboo layer 145 (measured in the vertical direction) may be less than the width of the first bamboo layer 135 (measured in the vertical direction).

As shown in FIG. 3, the first bamboo layer 135 may be joined to a second bamboo layer 145 along a first lamination plane 305. The first lamination plane 305 may be substantially normal to the first side surface 115 and may be substantially normal to the first end 105. Prior to joining the layers, the surfaces may be prepped to improve adhesion. For instance, coarse sand paper may be used to roughen the surfaces thereby making them more receptive to an adhesive. Any suitable adhesive may be used, and the adhesive may be applied to one or both of the mating surfaces. Once adequately prepped, joining may be accomplished by mating the bottom surface 315 of the first bamboo layer to the top surface 340 of the second bamboo layer 145. To ensure proper alignment and adhesion, the bamboo layers may be constrained while the adhesive cures. For example, the bamboo layers may be temporarily clamped or banded together.

As shown in FIG. 2, the shaft 100 may also include a third bamboo layer 140 extending from the first end 105 to the second end 110. The third bamboo layer 140 may be joined to the first bamboo layer 135 along a second lamination plane (not shown) that is substantially parallel to the first lamination plane 305. Like the second bamboo layer 145, the third bamboo layer 140 may extend from the first side 115 to the second side 120 as shown in FIGS. 6, 7, and 8. However, in some configurations, the third bamboo layer 140 may have a width less than the width of the first bamboo layer 135. For instance, when the layers are oriented in a vertical configuration as shown in FIG. 9, the width of the third bamboo layer 140 (measured in the vertical direction) may be less than the width of the first bamboo layer 135 (measured in the vertical direction).

As shown in FIG. 2, the shaft 100 may also include a fourth bamboo layer 155 extending from the first end 105 to the second end 110. The fourth bamboo layer 155 may be joined to the second bamboo layer 145 along a third lamination plane (not shown) that is substantially parallel to the first lamination plane 305. The fourth bamboo layer 155 may not extend from the first side 115 to the second side 120. For instance, as shown in FIG. 7, the width of the fourth bamboo layer 155 may be less than the width of the first bamboo layer 135. In addition, the thickness of the fourth bamboo layer 155 may be less than the thickness of the first bamboo layer 135.

As shown in FIG. 2, the shaft 100 may also include a fifth bamboo layer 150 extending from the first end 105 to the second end 110. The fifth bamboo layer 150 may be joined to the third bamboo layer 140 along a fourth lamination plane (not shown) that is substantially parallel to the first lamination plane 305. The fifth bamboo layer 150 may have a width that is less than the width of the first bamboo layer 135. For instance, as shown in FIG. 7, the width of the fifth bamboo layer 155 may be less than the width of the first bamboo layer 135. In addition, the thickness of the fifth bamboo layer 155 may be less than the thickness of the first bamboo layer 135.

Figure 4:
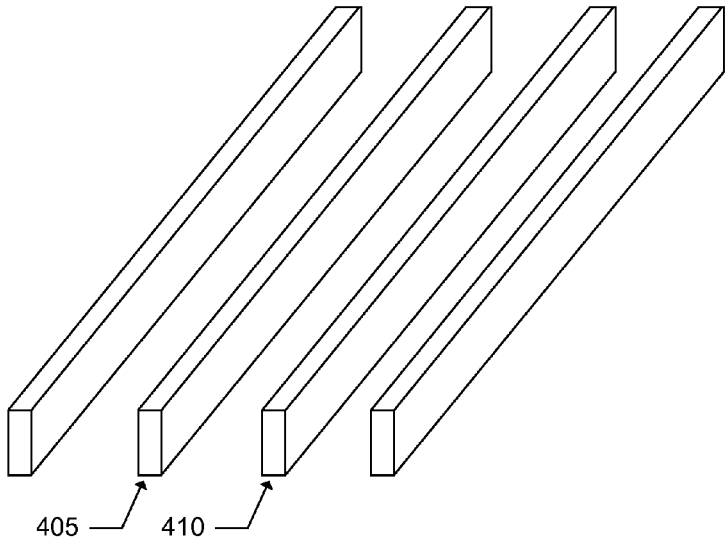
FIG. 4 is an exploded view of bamboo layers.
Figure 5:
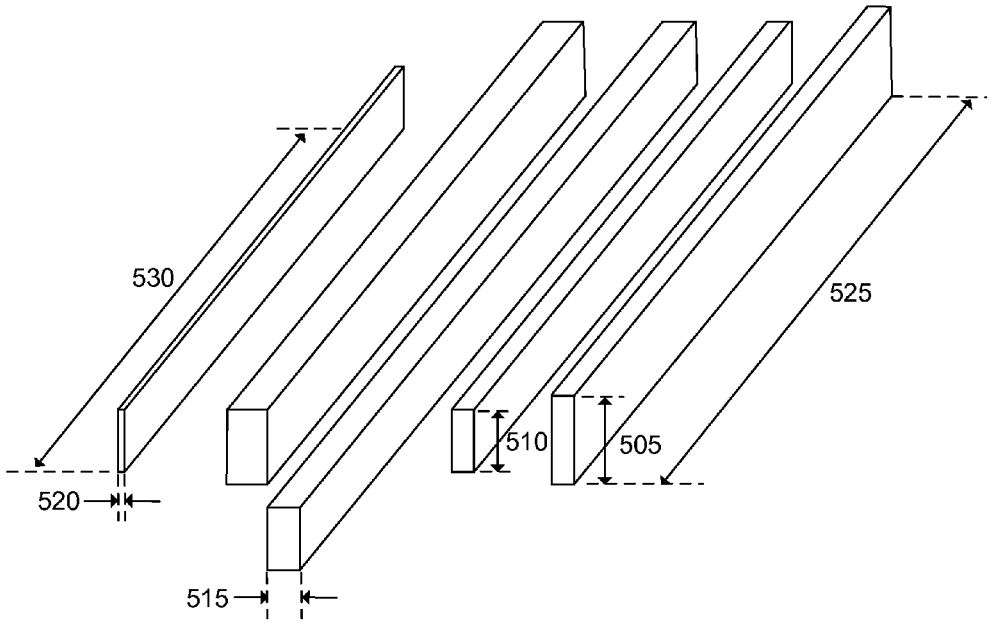
FIG. 5 is an exploded view of bamboo layers.

As shown in FIGS. 3, 4, and 5, the shaft 100 may be constructed from several bamboo layers joined together to form a bundle. To achieve an octagonal cross-section as shown in FIGS. 6-11, several methods may be employed. For example, as shown in FIG. 3, appropriately shaped layers may be joined to form an octagonal cross-section. Alternately, as shown in FIG. 4, several similarly shaped bamboo layers (e.g. 405, 410) may be joined to form a bundle and then machined to create a octagonal cross-section. For instance, as shown in FIG. 12, a rectangular bundle 1230 may be formed and machined along four edges (e.g 1235, 1240, 1245) to create eight surfaces along the length of the bundle. An end mill bit 1225 may be adjusted to a 45 degree angle relative to a vertical plane and may traverse along the length of the bundle to form a new surface 1205. Alternately, to form the new surface 1205, the bit 1225 may be held fixed while the bundle is forced past the rotating bit. Similarly, three additional surfaces may be created by passing the bit along cut planes 1210, 1215, and 1220. By doing so, an octagonal cross-section is created.

Although the bamboo layers within the bundle 1230 may have similar dimensions, they may also differ. For instance, as shown in FIG. 5, the layers may have differing widths (e.g. 505, 510), thicknesses (e.g. 515, 520), and lengths (e.g. 525, 530). However, once the bamboo layers are joined, the bundle may be squared using an end mill, band saw, or other suitable process.

Figure 10:
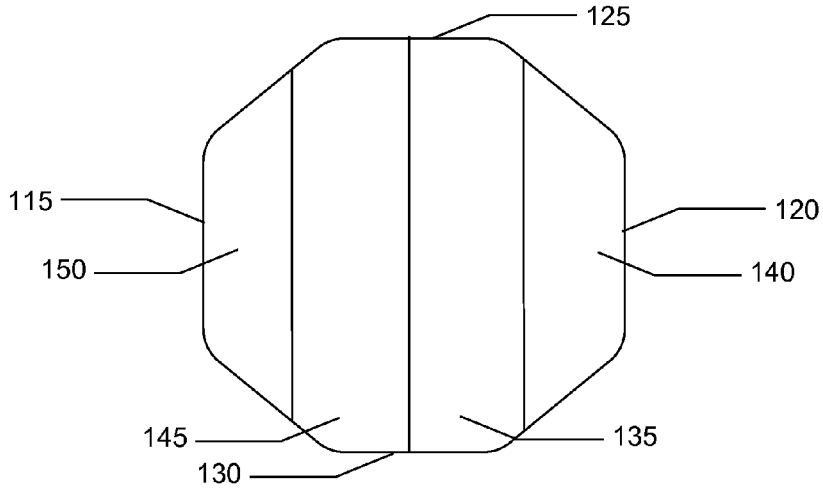
FIG. 10 is an end view of a bamboo lacrosse shaft.
Figure 11:
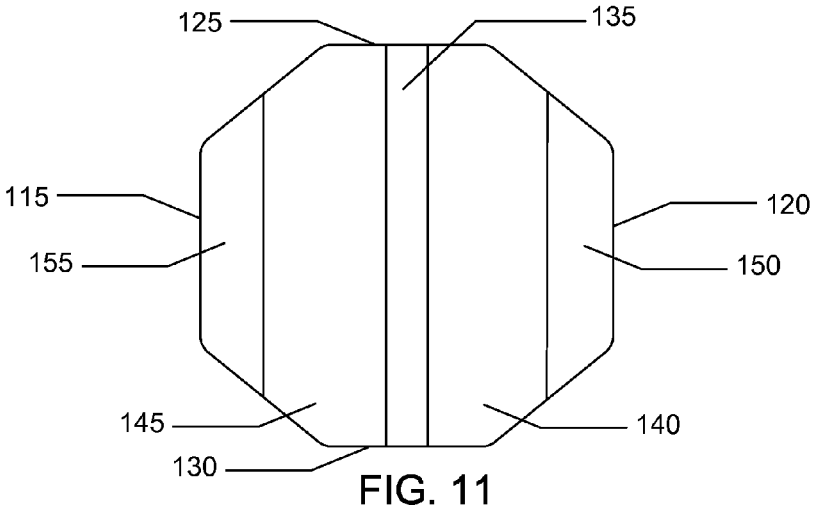
FIG. 11 is an end view of a bamboo lacrosse shaft.
Figure 12:
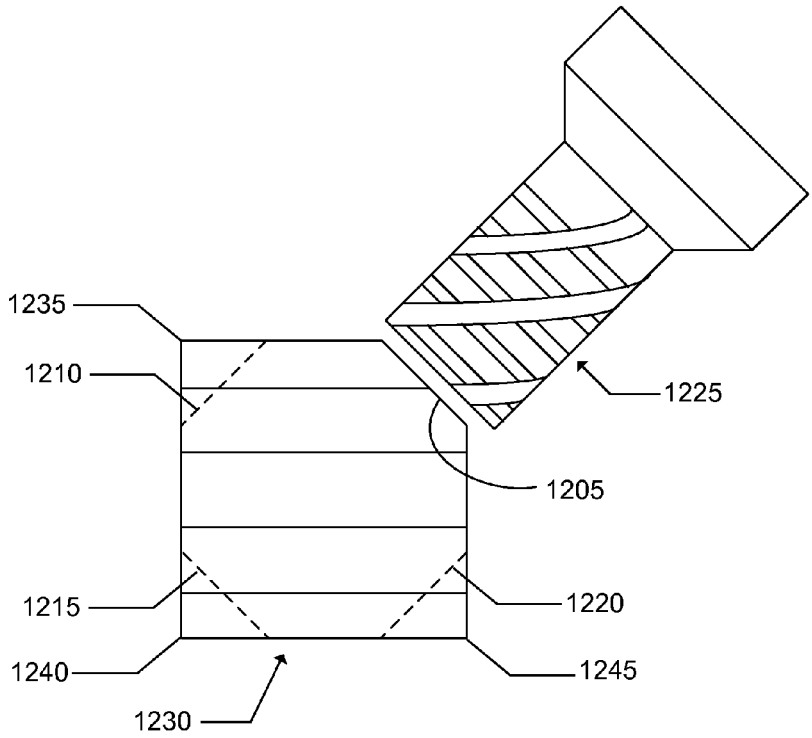
FIG. 12 is an end view of a bundle of bamboo layers and an end mill bit.
Figure 13:
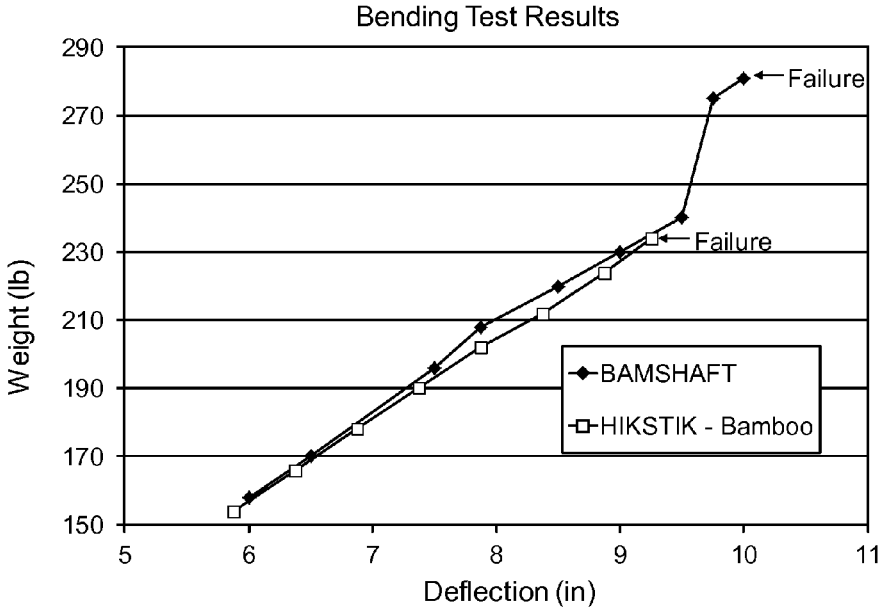
FIG. 13 is a chart showing bending test results for two bamboo lacrosse shafts.

FIGS. 6 through 11 show end views of example lacrosse shafts. As shown in FIGS. 6-8, the layers may be oriented to form horizontal lamination planes. In particular, the layers may be arranged with lamination planes that are parallel to the top surface 125 and normal to the first end surface 105. Conversely, as shown in FIGS. 9-11, the layers may be oriented to form vertical lamination planes. In particular, the layers may be arranged with lamination planes that are normal to the top surface 125 and normal to the first end surface 110. Alternately, the lamination planes may appear in any orientation so long as the lamination planes are parallel. As described above, the number of bamboo layers in the shaft may vary. For instance, the shaft may have three or fewer layers as shown in FIG. 9, or the shaft may have six or more layers as shown in FIG. 8. Alternately, the shaft may have 4 or 5 layers as shown in FIGS. 6 and 7, respectively. In addition, the layers may have uniform thicknesses as shown in FIG. 6, or they may have varying thicknesses as shown in FIG. 11. In addition, the layers may be arranged symmetrically as shown in FIG. 11. Alternately, the layers may be arranged asymmetrically.

Figure 14:
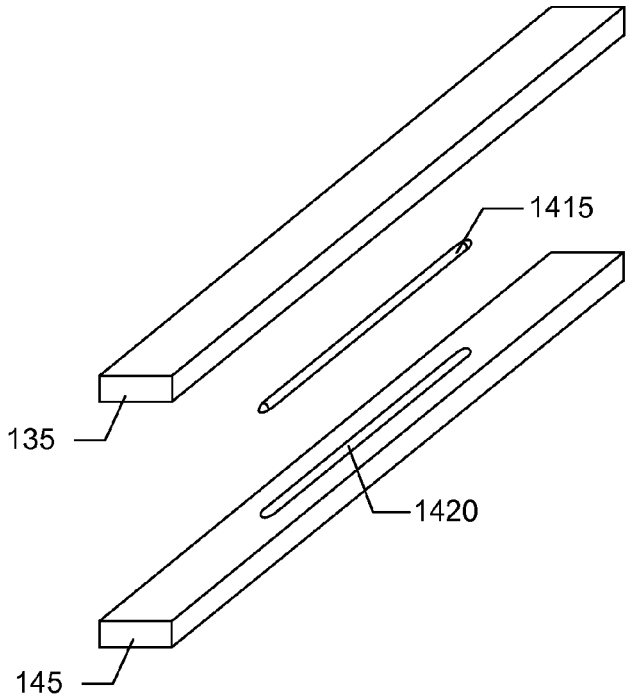
FIG. 14 is an exploded view of two bamboo layers and a reinforcement member.

During a field lacrosse game, four players on each team are permitted to carry a d-pole, which is also known as a "long crosse" or "long stick." D-poles can be up to 72 inches in length, whereas other sticks, such as attack sticks, range from about 24-36 inches. Due to the d-pole's length, it can experience greater flexing than shorter sticks and can, therefore, be more prone to breaking. To prevent excessive bending and subsequent breaking, the shaft can be reinforced in one or more ways. For instance, a reinforcement member can be incorporated into the shaft. In one example, the reinforcement member can be a longitudinal reinforcement member, as shown in FIG. 14, which depicts an exploded view of a reinforcement member 1415 located between a first and second bamboo layer (135, 145).

By adjusting the length, width and placement of the reinforcement member 1415 within the shaft, the stiffness of the shaft can be adjusted to a desired value. In one example, the reinforcement member 1415 can extend substantially the entire length of the shaft. In another example, the reinforcement member can extend less than the entire length of the shaft, such as about 10-80%, 25-75% or 30-60% of the length of the shaft measured between the first and second ends (105, 110) of the shaft. In another example, the width of the reinforcement member 1415 can range from about 0.125-1.0 inches, and, more preferably, from about 0.25-0.5 inches. The reinforcement member can include any suitable material such as, for example carbon fiber, aluminum, steel, titanium or fiberglass.

Figure 15:
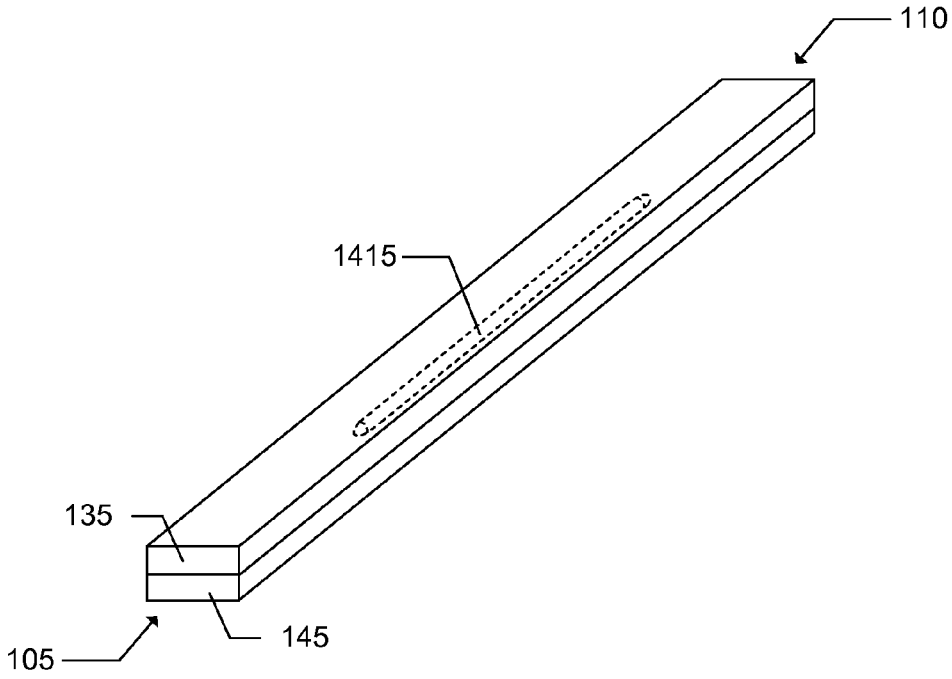
FIG. 15 is a perspective view of two bamboo layers with a reinforcement member.

To house the reinforcement member 1415, a recess 1420 can be formed in the first bamboo layer 135, the second bamboo layer 145, or both layers (135, 145). The recess 1420 can be formed by any suitable woodworking process such as routering, drilling, chiseling, sanding or carving. To prevent movement of the reinforcement member 1415 within the recess 1420 during play, it is desirable to form a snug fit between the reinforcement member 1415 and the recess 1420. In one example, a friction fit may exist between the reinforcement member 1415 and the recess 1420. Alternately, or in addition to a snug fit, adhesive may be applied to keep the reinforcement member 1415 in place. FIG. 15 shows a perspective view of the components after the first and second bamboo layers (135, 145) have been joined along a first lamination plane. The location of the reinforcement member 1415 within the bamboo layers (135, 145) is represented by dashed lines.

Figure 16:
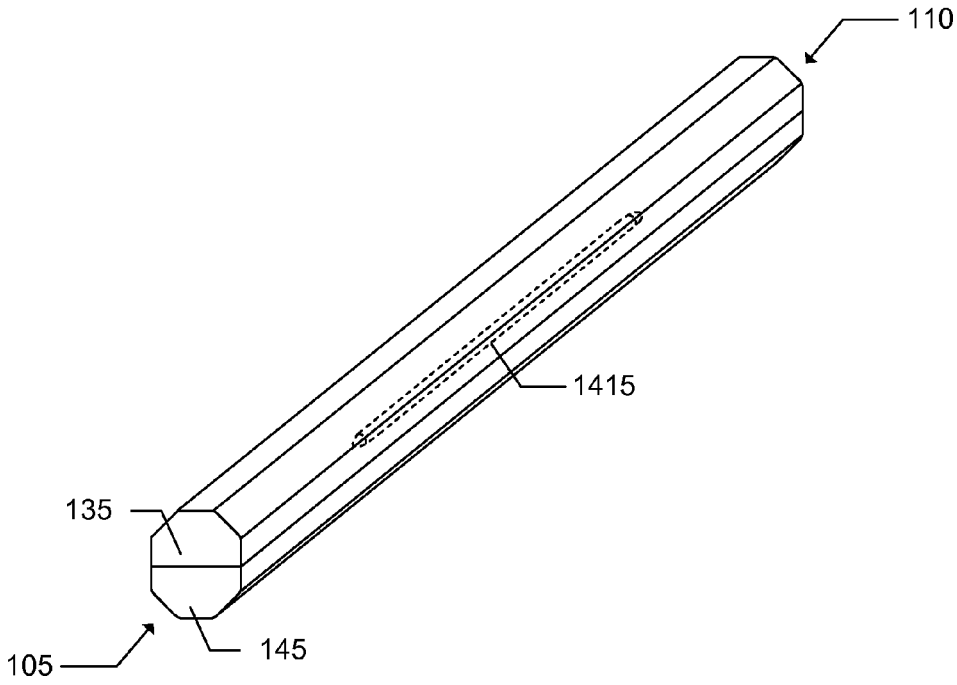
FIG. 16 is a perspective view of a bamboo lacrosse shaft with a reinforcement member.
Figure 17:
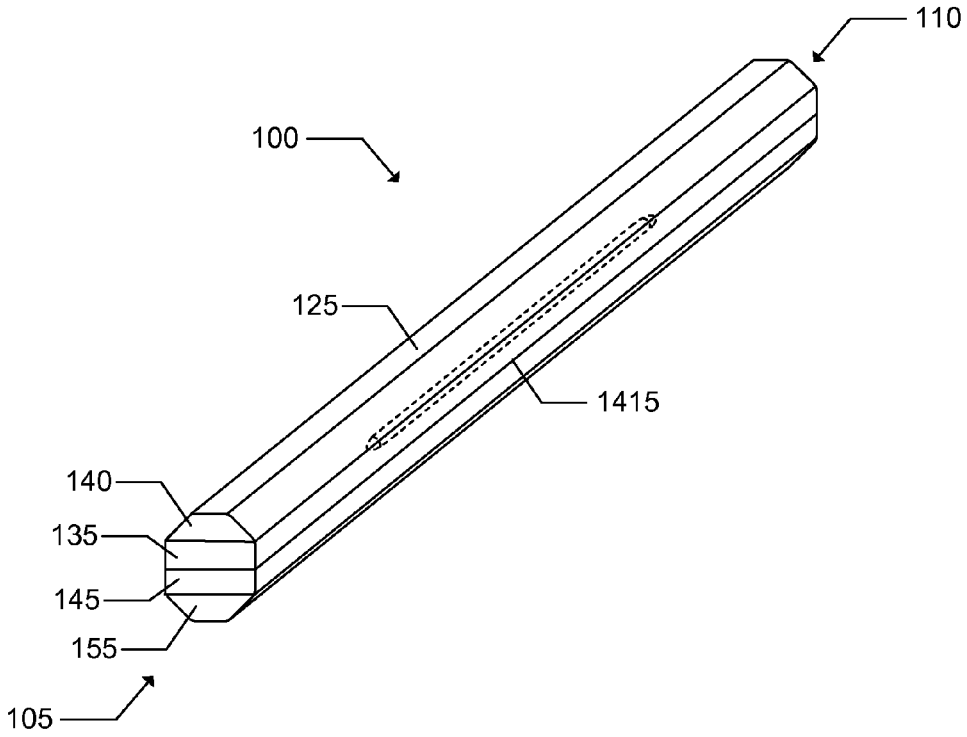
FIG. 17 is a perspective view of a bamboo lacrosse shaft with a reinforcement member.

As noted above, it can be desirable to manufacture a shaft having an octagonal cross-section. FIG. 16 shows a shaft with an octagonal cross-section that is formed from two bamboo layers (135, 145). Alternately, the shaft can include more than two bamboo layers as shown in FIG. 17. For instance, the shaft can include a third bamboo layer 140 joined to the first bamboo layer 135 and a fourth bamboo layer 155 joined to the second bamboo layer 145. The bamboo layers can be joined by applying an adhesive along their mating surfaces. The adhesive can include any suitable adhesive such as, for example, epoxy, silicone rubber or wood glue.

In one example, the first and second bamboo layers (135, 145), as shown in FIG. 16, can each include multiple layers. For instance, the first bamboo layer 135 can include two or more bamboo layers joined with adhesive, and, similarly, the second bamboo layer 145 can include two or more bamboo layers joined with adhesive. The multiple layers can form bamboo plywood, which includes a variety of smaller bamboo pieces assembled and joined to form larger bamboo layers, such as the first or second bamboo layers (135, 145).

Figure 18:
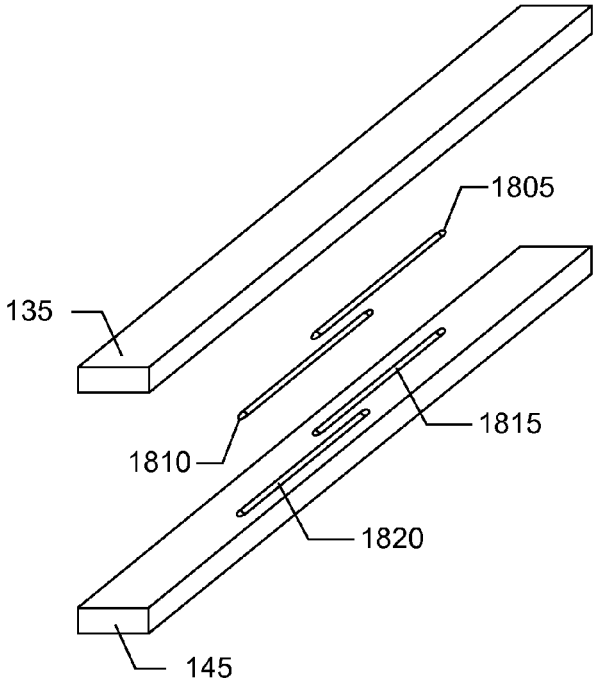
FIG. 18 is a perspective view of two bamboo layers with reinforcement members.

As noted above, the length of the reinforcement member 1415 can be adjusted to tailor the rigidity of the shaft. The shaft's rigidity can also be tailored by adjusting the number of reinforcement members within the shaft. For instance, the shaft can include more than one reinforcement member. As shown by way of example in FIG. 18, the shaft can include a first reinforcement member 1805 and a second reinforcement member 1810. The shaft can also include a first recess 1815 and a second recess 1820 to house the first and second reinforcement members (1805, 1810), respectively. As shown in FIG. 18, the reinforcement members (1805, 1810) can be arranged in a staggered position to provide greater stiffness near the midpoint of the shaft which can experience the most severe bending. As a result, the likelihood of breaking is significantly diminished. In another example, the shaft can include more than two reinforcement members arranged in any suitable configuration to prevent excessive bending near the midpoint of the shaft.

Figure 19:
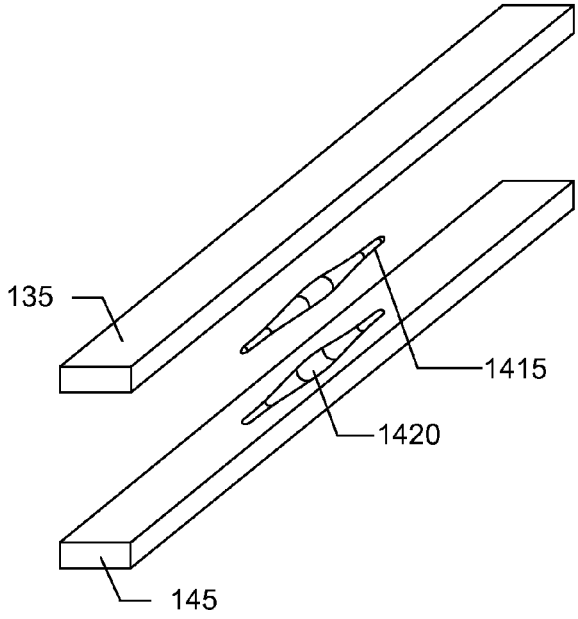
FIG. 19 is a perspective view of two bamboo layers with a reinforcement member.

The shaft's rigidity can also be tailored by modifying the geometry of the reinforcement member 1415. In fact, the reinforcement member 1415 can assume any suitable shape. In one example shown in FIG. 19, the reinforcement member 1415 can have a cross-sectional area that varies continuously along its length. Consequently, the member 1415 provides maximum bending resistance near the shaft's midpoint and incrementally less bending resistance outwardly from the shaft's midpoint toward the first and second ends (105, 110). In addition, the ends of the reinforcement member can be rounded to further reduce the likelihood of breaking. For example, if the reinforcement member is a rod, such as a carbon fiber rod, the ends of the rod may be rounded to eliminate or reduce stress risers that would otherwise promote breaking.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawings are not necessarily to scale, presenting a somewhat simplified representation of various features illustrative of the basic principles of the invention.

What is claimed is:

1. A lacrosse shaft comprising: a first end having an octagonal cross-section; a second end opposite the first end; a first side surface having a first length along a first edge of the octagonal cross-section;

a second side surface opposite the first side surface, the second side surface having a second length along a second edge of the octagonal cross-section;

a top surface having a third length along a third edge of the octagonal cross-section; a bottom surface opposite the top surface, the bottom surface having a fourth length along a fourth edge of the octagonal cross-section, wherein the first and second lengths are longer than the third and fourth lengths;

a first bamboo layer extending substantially from the first end to the second end and extending substantially from the first side surface substantially to the second side surface, the first bamboo layer having a width between 0.5 and 1.5 inches; a second bamboo layer extending substantially from the first end to the second end and joined to a first surface of the first bamboo layer along a first lamination plane substantially normal to the first side surface, substantially normal to the first end, and parallel to the top and bottom surface, wherein the second bamboo layer has a width less than the first bamboo layer; and a reinforcement member located between the first and second ends and disposed within the first or second bamboo layer, wherein the reinforcement member extends 30-60% of the distance between the first and second ends of the lacrosse shaft and is configured to provide maximum bending resistance at a midpoint of the lacrosse shaft: wherein a second surface of the first bamboo layer is joined to a first surface of a third bamboo layer along a second lamination plane substantially parallel to the first lamination plane, wherein the third bamboo layer has a width less than the width of the first bamboo layer, wherein all lamination planes in a cross section perpendicular to a length of the shaft are oriented in the same direction and are substantially parallel, and wherein the shaft is configured to receive a lacrosse head.

2. The lacrosse shaft of claim 1, wherein the cross-sectional area of the reinforcement member ranges between 0.125-1.0 inches.

3. The lacrosse shaft of claim 2, wherein the cross-sectional area of the reinforcement member ranges between 0.25-0.5 inches.

4. The lacrosse shaft of claim 1, wherein the reinforcement member comprises carbon fiber, aluminum, steel, titanium or fiberglass.

5. The lacrosse shaft of claim 1, wherein the reinforcement member comprises a carbon fiber rod.

6. The lacrosse shaft of claim 1, wherein the reinforcement member comprises rounded ends.

7. The lacrosse shaft of claim 1, wherein the reinforcement member is captured in a recess in the first bamboo layer.

8. The lacrosse shaft of claim 1, wherein the reinforcement member is captured in a recess in the second bamboo layer.

9. The lacrosse shaft of claim 1, wherein the plurality of reinforcement members are positioned in a center portion along the length of the first and second bamboo layers.

10. A method of manufacturing the lacrosse shaft of claim 1, the method comprising: providing a first bamboo layer comprising: a first end; a second end opposite the first end; a first side surface; a second side surface opposite the first side surface; a top surface; a bottom surface; inserting one of a plurality of reinforcement members into each of the plurality of recesses; joining a first surface of the first bamboo layer to a second bamboo layer along a first lamination plane, wherein the plurality of reinforcement members are captured between the first and second bamboo layers; joining a second surface of the first bamboo layer to a third bamboo layer along a second lamination plane; and machining the bamboo layers to produce a lacrosse shaft having an octagonal cross-section such that the first side surface has a first length along a first edge of the octagonal cross-section, the second side surface has a second length along a second edge of the octagonal cross-section, the top surface has a third length along a third edge of the octagonal cross-section, the bottom surface has a fourth length along a fourth edge of the octagonal cross-section, and the first and second lengths are longer than the third and fourth lengths, wherein the first lamination plane is substantially normal to the first side surface, substantially normal to the first end, and parallel to the top and bottom surface, wherein all lamination planes in a cross section perpendicular to a length of the shaft are oriented in the same direction and are substantially parallel, wherein the second bamboo layer has a width less than the first bamboo layer and the third bamboo layer has a width less than the width of the first bamboo layer, wherein the plurality of reinforcement members extend 30-60% of the distance between the first and second ends of the lacrosse shaft and are configured to provide maximum bending resistance at a midpoint of the lacrosse shaft: and wherein the shaft is configured to receive a lacrosse head.

11. The method of claim 10, further comprising forming a plurality of second recesses in the second bamboo layer prior to joining the first and second bamboo layers, wherein the plurality of second recesses receives at least a portion of the plurality of reinforcement members.

12. The method of claim 10, wherein forming the plurality of recesses in the first bamboo layer comprises routering a plurality of recesses in the first bamboo layer.

13. The method of claim 11, wherein forming the plurality of recesses in the second bamboo layer comprises routering a plurality of recesses in the second bamboo layer.

14. The method of claim 10, wherein the first bamboo layer comprises a plurality of bamboo pieces.

15. The method of claim 10, wherein the second bamboo layer comprises a plurality of bamboo pieces.

16. The method of claim 10, wherein the ends of the plurality of reinforcement members are rounded.

* * * * *